United States Patent [19]

Spadini et al.

[11] 4,338,204

[45] Jul. 6, 1982

[54] DETERGENT SOFTENER CONTAINING ANIONIC, AMINE, AND WATER SOLUBLE CATIONIC

[75] Inventors: Gianfranco L. Spadini, Cincinnati, Ohio; Peter N. Crisp, Gateshead; Allan C. McRitchie, Whitley Bay, both of England

[73] Assignee: The Procter & Gamble Company, Cincinnati, Ohio

[21] Appl. No.: 189,413

[22] Filed: Sep. 22, 1980

[30] Foreign Application Priority Data

Sep. 29, 1979 [GB] United Kingdom ..... 7933869

[51] Int. Cl.[3] ..... C11D 1/65; D06M 13/46

[52] U.S. Cl. ..... 252/8.75; 252/99; 252/525; 252/528; 252/544; 252/547; 252/8.8

[58] Field of Search ..... 252/8.8, 8.75, 528, 252/525, 547, 99

[56] References Cited

U.S. PATENT DOCUMENTS

| | | | |
|---|---|---|---|
| 140517 | 3/1976 | Clint et al. | 215/359 |
| 3,256,180 | 6/1966 | Weiss | 252/8.8 |
| 3,696,056 | 10/1972 | Inamorato | 252/25 |
| 3,886,075 | 5/1975 | Bernadino | 252/8.75 |
| 3,993,573 | 11/1976 | Gloss | 252/528 X |
| 4,149,978 | 4/1979 | Goffinet | 252/8.75 |
| 4,155,855 | 5/1979 | Goffinet et al. | 252/8.75 |
| 4,203,852 | 5/1980 | Johnson et al. | 252/8.8 |
| 4,237,155 | 12/1980 | Kardouche | 427/242 |
| 4,292,035 | 9/1981 | Battrell | 8/137 |
| 4,294,710 | 10/1981 | Hardy et al. | 252/8.8 |

FOREIGN PATENT DOCUMENTS

| | | |
|---|---|---|
| 225 | 1/1979 | European Pat. Off. . |
| 235 | 1/1979 | European Pat. Off. . |
| 1234092 | 8/1972 | United Kingdom . |
| 1382431 | 1/1975 | United Kingdom . |
| 1514276 | 6/1978 | United Kingdom . |

*Primary Examiner*—P. E. Willis, Jr.

[57] ABSTRACT

A laundry detergent composition providing cleaning and softening of textiles comprises an anionic surfactant, a water-insoluble di $C_{10}$–$C_{26}$ tertiary amine, and a water-soluble cationic compound which may be a mono $C_{10}$–$C_{18}$ alkyl primary, secondary or tertiary amine, or a water-soluble salt thereof or a water-soluble mono $C_8$–$C_{16}$ alkyl quaternary ammonium compound. A smectite clay serving as an additional textile softening agent and a detergent builder salt are preferred components of the granular form of the composition which may contain other conventional detergent ingredients.

25 Claims, No Drawings

DETERGENT SOFTENER CONTAINING ANIONIC, AMINE, AND WATER SOLUBLE CATIONIC

FIELD OF THE INVENTION

This invention relates to detergent compositions that clean well and also act as textile softeners.

BACKGROUND OF THE INVENTION

Numerous attempts have been made to formulate laundry detergent compositions that have both good cleaning properties and also textile softening properties so as to avoid the necessity of using a separate rinse-added textile softener product in addition to the usual laundry detergent. As cleaning by definition involves the removal of material from the textile surface and as textile softening normally involves deposition of material onto the same surface, these attempts have necessarily required a compromise in formulation to be reached between cleaning and softening performance.

The most common commercially available organic textile softening compounds are cationic materials that are reactive towards the anionic surfactants used in conventional laundry detergents. If both types of material are formulated in a single product, they tend to interact on addition to a wash liquor and, although in some instances the resulting complex has useful textile softening properties, its formation normally depresses the cleaning performance of the formulation and is therefore generally considered undesirable.

In order to overcome this problem, compositions have been proposed which have sought to minimise the mutual reactivity of the anionic and cationic materials by the addition of compatibilising compounds as described for example in U.S. Pat. Nos. 3,886,075 and 3,954,632.

An alternative approach has been to incorporate one of the reactant materials in a form that inhibits its contact with the other in the wash liquor and examples of this type of formulation are taught in U.S. Pat. Nos. 3,936,537 and 3,644,203. The performance of these compositions is however sensitive to the washing conditions that are employed. In an attempt to avoid the reactivity problem altogether, nonionic surfactants have been proposed in place of the conventional anionic surfactants and compositions of this type are described in e.g. British Pat. No. 1,079,388, German Auslegeschrift No. 1,220,956 and U.S. Pat. No. 3,607,763. However it has been found that levels of nonionic surfactant sufficient to provide good cleaning impair the softening of the cationic softener. Another proposal to provide acceptable cleaning and textile softening by avoiding the surfactant-softener interaction has been made in British Pat. No. 1,514,276 which teaches the use of certain long chain tertiary amines that are nonionic in character at the wash liquor pH existing when a conventional laundry detergent is used. The commonly-assigned European Patent Application No. 11340 published May 28, 1980 and British Application No. 7923527 filed July 5, 1979 respectively also disclose cleaning and softening compositions comprising a combination of a long chain tertiary amine and a smectite-type clay in an anionic surfactant based detergent. The use of smectite-type clays as softening agents in detergent compositions is taught in British Pat. No. 1,400,898. This type of softening agent does not affect the cleaning performance of the detergent composition but, if used on its own, requires a high level of incorporation for effective softening performance possibly because the deposition of the clay on fabrics is not very efficient in the presence of anionic surfactants.

In summary therefore the prior art attempts to provide detergent compositions having textile softening capability have been of two general types. The first type has employed cationic fabric softening additives in anionic-surfactant based compositions and has sought to achieve the best compromise between these antagonistic components. The second type has replaced one or other of these components by a substitute which is not antagonistic but which is not capable of providing the same level of performance.

The current practice in providing a fabric softeners benefits to fabrics in domestic laundering operations is to add a cationic fabric softener either as a liquid to the final rinse of the washing process or as a separate additive to a hot air tumbler dryer. Although this avoids direct antogonism between the cationic softener and the anionic surfactants conventionally used in laundry detergents, some decrease in fabric whiteness occurs because of the yellowing effect of the deposited fabric softener.

It has now been found that detergent compositions can be formulated which have cleaning performance equivalent to that of commercially available heavy duty laundry detergents together with textile softening performance that approaches that of rinse added fabric softeners without the yellowing effect normally associated with the use of such softeners.

SUMMARY OF THE INVENTION

According to the present invention there is provided a detergent composition comprising (a) about 3%–30% of an anionic surfactant (b) about 1%–25% of a tertiary amine having the general formula

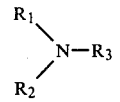

wherein $R_1$ is a $C_{10}$–$C_{26}$ alkyl or alkenyl group, $R_2$ is as $R_1$ or, if $R_1$ is a $C_{20}$–$C_{26}$ alkyl or alkenyl group, may be a $C_1$–$C_7$ alkyl group and $R_3$ has the formula $—CH_2—Y$ wherein Y is H, $C_1$–$C_6$ alkyl

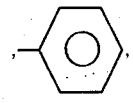

$—CH_2OH$, $—CH{=}CH_2$, $—CH_2CH_2OH$, $—CH_2CN$

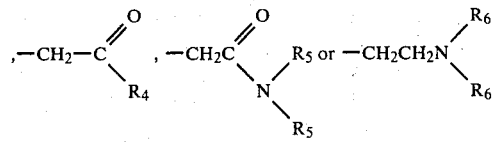

wherein $R_4$ is a $C_1$–$C_4$ alkyl group, each $R_5$ is independently H or $C_1$–$C_{20}$ alkyl; and each $R_6$ is independently H or $C_1$–$C_{20}$ alkyl; and (c) about 0.5%–10% of an organic nitrogenous cationic capable of existing in cationic form in a 0.1% aqueous solution of pH 10, and selected from the group consisting of (i) quaternary ammonium compounds of formula $$R_7R_8R_9R_{10}N^+X$$

wherein $R_7$ is $C_8$–$C_{16}$ alkyl, each of $R_8$, $R_9$ and $R_{10}$ is independently $C_1$–$C_4$ alkyl or hydroxy alkyl, benzyl, or $—(C_2H_4O)_xH$ where x has a value from 2 to 5, not more than one of $R_8$, $R_9$ or $R_{10}$ being benzyl and wherein X is an anion; and (ii) aliphatic amines of general formula $R_{11}R_{12}R_{13}N$ wherein $R_{11}$ is $C_8$–$C_{18}$ alkyl, $R_{12}$ and $R_{13}$ are independently hydrogen, $C_1$–$C_4$ alkyl or hydroxyalkyl, benzyl, or $—(C_2H_4O)_xH$ where x has a value from 2 to 5, and water soluble salts thereof; provided that the molar ratio of component (c) to component (a) does not exceed about 1:1.

It is desirable that the molar ratio of (c) to (a) does not exceed about 1:1.5 and normally the molar ratio will be less than about 1:2 in heavy duty laundry detergent compositions.

Preferably component (b) is a di $C_{16}$–$C_{22}$ alkyl $C_1$–$C_4$ alkyl amine in which the $C_{16}$–$C_{22}$ alkyl groups are derived from animal fats, and component (c) is a $C_{12}$–$C_{14}$ alkyl tri $C_1$–$C_4$ alkyl or $C_1$–$C_4$ hydroxy alkyl ammonium salt. In a preferred embodiment of the invention a further component (d) is present comprising from 1.5% to 35% by weight of the composition of an impalpable smectite-type clay having an ion exchange capacity of at least about 50 meq per 100 g., a particularly preferred clay being a montmorillonite. In an especially preferred form of this embodiment the tertiary amine component (b) is added to preformed spray-dried detergent granules comprising components (a), (c), (d) and also a detergent builder salt component (e).

DETAILED DESCRIPTION OF THE INVENTION

In its broadest aspect the invention comprises three components, namely the anionic surfactant component (a), the tertiary amine component (b), and the water soluble cationic component (c).

(a) The Anionic Surfactant

A wide range of anionic surfactants can be used in the compositions of the present invention.

Suitable anionic non-soap surfactants are water soluble salts of alkyl benzene sulfonates, alkyl sulfates, alkyl polyethoxy ether sulfates, paraffin sulfonates, alphaolefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonates, and beta-alkyloxy alkane sulfonates. Soaps are also suitable anionic surfactants.

Especially preferred alkyl benzene sulfonates have about 9 to about 15 carbon atoms in a linear or branched alkyl chain, more especially about 11 to about 13 carbon atoms. Suitable alkyl sulfates have about 10 to about 22 carbon atoms in the alkyl chain, more especially from about 12 to about 18 carbon atoms. Suitable alkyl polyethoxy ether sulfates have about 10 to about 18 carbon atoms in the alkyl chain and have an average of about 1 to about 12 $—CH_2CH_2O—$ groups per molecule, especially about 10 to about 16 carbon atoms in the alkyl chain and an average of about 1 to about 6 $—CH_2CH_2O—$ groups per molecule.

Suitable paraffin sulfonates are essentially linear and contain from about 8 to about 24 carbon atoms, more especially from about 14 to about 18 carbon atoms. Suitable alphaolefin sulfonates have about 10 to about 24 carbon atoms, more especially about 14 to about 16 carbon atoms; alphaolefin sulfonates can be made by reaction with sulfur trioxide followed by neutralization under conditions such that any sultones present are hydrolyzed to the corresponding hydroxy alkane sulfonates. Suitable alpha-sulfocarboxylates contain from about 6 to about 20 carbon atoms; included herein are not only the salts of alpha-sulfonated fatty acids but also their esters made from alcohols containing about 1 to about 14 carbon atoms.

Suitable alkyl glyceryl ether sulfates are ethers of alcohols having about 10 to about 18 carbon atoms, more especially those derived from coconut oil and tallow. Suitable alkyl phenol polyethoxy ether sulfates have about 8 to about 12 carbon atoms in the alkyl chain and an average of about 1 to about 6 $—CH_2CH_2O—$ groups per molecule. Suitable 2-acyloxy-alkane-1-sulfonates contain from about 2 to about 9 carbon atoms in the acyl group and about 9 to about 23 carbon atoms in the alkane moiety. Suitable beta-alkyloxy alkane sulfonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanol-ammonium cations; sodium is preferred. Mixtures of anionic surfactants are contemplated by this invention; a satisfactory mixture contains alkyl benzene sulfonate having 11 to 13 carbon atoms in the alkyl group and alkyl sulfate having 12 to 18 carbon atoms in the alkyl group.

Suitable soaps contain about 8 to about 18 carbon atoms, more especially about 12 to about 18 carbon atoms. Soaps can be made by direct saponification of natural fats and oils such as coconut oil, tallow and palm oil, or by the neutralization of free fatty acids obtained from either natural or synthetic sources. The soap cation can be alkali metal, ammonium or alkanol-ammonium; sodium is preferred.

The compositions contain from about 3% to about 30% of anionic detergent, preferably from about 4% to about 15% and normally from about 5% to about 10% by weight of the composition.

(b) The Tertiary Amine

Tertiary amines suitable for the purposes of the invention are highly water insoluble compounds that have the general formula:

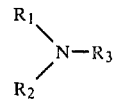

wherein $R_1$ is a $C_{10}$–$C_{26}$ alkyl or alkenyl group $R_2$ is the same as $R_1$ or if $R_1$ is a $C_{20}$–$C_{26}$ alkyl or alkenyl group, may be a $C_1$–$C_7$ alkyl group and $R_3$ has the formula $—CH_2—Y$ wherein Y is H, $C_1$–$C_6$ alkyl

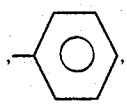

$-CH_2OH$, $-CH{=}CH_2$, $-CH_2CH_2OH$,

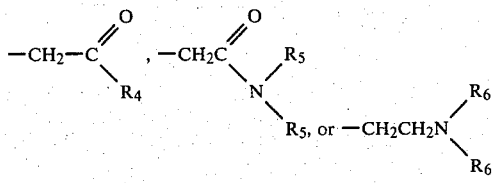

wherein $R_4$ is a $C_1$–$C_4$ alkyl group, each $R_5$ is independently H or $C_1$–$C_4$ alkyl and each $R_6$ is independently H or $C_1$–$C_{20}$ alkyl. Preferably $R_1$ and $R_2$ each independently represent a $C_{12}$–$C_{22}$ alkyl group, preferably straight chained, and $R_3$ is methyl, or ethyl. Suitable amines include di decyl methylamine
di lauryl methylamine
di myristyl methylamine
di cetyl methylamine
di stearyl methylamine
di arachadyl methylamine
di behenyl methylamine
arachadyl behenyl methylamine or
di (mixed arachidyl/behenyl) methylamine
di (tallowyl) methylamine
arachidyl/behenyl dimethylamine and the corresponding ethyl amines, propylamines and butyl amines. Especially preferred is ditallowyl methylamine. This is commercially available as Armeen M2HT from Azko N.V. and as Genamin SH301 from Farbewerke Hoechst.

When Y is

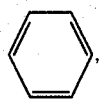

$-CH{=}CH_2$, $-CH_2OH$

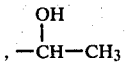

or $-CH_2-CN$, suitable amines include:

Didecyl benzylamine
dilauryl benzylamine
dimyristyl benzylamine
dicetyl benzylamine
distearyl benzylamine
dioleyl benzylamine
dilinoleyl benzylamine
diarachidyl benzylamine
dibehenyl benzylamine
di(arachidyl/behenyl) benzylamine
ditallowyl benzylamine and the corresponding allylamines, hydroxy ethylamines, hydroxy propylamines, and 2-cyanoethylamines. Especially preferred are ditallowyl benzylamine and ditallowyl allylamine.

Mixtures of any of these amines may be used.

The compositions should contain from about 1% to about 25% by weight of the tertiary amine preferably from about 1% to about 15% by weight and most preferably from about 3% to about 6% by weight.

(c) The Water-Soluble Cationic Compound

The third essential component of the compositions of the present invention is a nitrogenous organic compound capable of existing in cationic form in a 0.1% aqueous solution of pH 10. This compound may be of any of the following types;

(1) Quaternary ammonium compounds of formula $$R_7R_8R_9R_{10}N^+ X^-$$

wherein $R_7$ is $C_8$–$C_{16}$ alkyl, each of $R_8$, $R_9$, and $R_{10}$ is independently selected from $C_1$–$C_4$ alkyl, $C_1$–$C_4$ hydroxy alkyl, benzyl, and $-(C_2H_4O)_xH$ where x has a value from 2 to 5, and X is an anion. Not more than one of $R_8$, $R_9$, and $R_{10}$ should be benzyl. The preferred alkyl chain length for $R_7$ is $C_{12}$–$C_{14}$ particularly where the alkyl group is a mixture of chain lengths derived from coconut or palm kernel fat or is derived synthetically by olefin build up or OXO alcohol synthesis. Preferred groups for $R_8$ $R_9$ and $R_{10}$ are methyl and hydroxyethyl groups and the anion X may be selected from halide, methosulphate, acetate and phosphate ions. Examples of suitable quaternary ammonium compounds are coconut trimethyl ammonium chloride
coconut methyl dihydroxyethyl ammonium chloride
decyl triethyl ammonium chloride
decyl dimethyl hydroxyethyl ammonium bromide
myristyl trimethyl ammonium methyl sulphate
lauryl dimethyl benzyl ammonium bromide
lauryl methyl (ethenoxy)$_4$ ammonium bromide (2) Aliphatic amines of general formula $$R_{11}R_{12}R_{13}N$$

wherein $R_{11}$ is $C_8$–$C_{14}$ alkyl, $R_{12}$ and $R_{13}$ are independently selected from hydrogen, $C_1$–$C_4$ alkyl, $C_1$–$C_4$ hydroxyalkyl, benzyl or $-(C_2H_4O)_xH$ where x has a value from 2 to 5 and water soluble salts thereof. Suitable amines can be primary, secondary or tertiary examples being:

Secondary Coconut methylamine
primary myristyl amine
lauryl dimethyl amine
lauryl diethyl amine
decyl dihydroxy ethyl amine
cetyl dimethyl amine
secondary lauryl benzyl amine
Coconut dimethyl amine
dodecyl dipropyl amine
tallow dimethyl amine and their corresponding hydrohalide salts.

For the purposes of the present invention it is essential that the cationic compound should not be present in molar excess over the anionic detergent and it is highly preferable that the molar ratio of cationic compound to anionic detergent be less than 1:1.5 and most preferably less than 1:2. For conventional laundry detergent compositions the water soluble cationic compound is present in an amount of from about 0.5% to about 10% by weight of the composition, preferably from about 1% to about 4% and most preferably from about 1.5% to about 3% by weight.

OPTIONAL INGREDIENTS

The detergent compositions of the present invention may of course include, as optional ingredients, components that are usually found in laundry detergents.

These include nonionic and zwitterionic surfactants, builder salts, bleaching agents and organic precursors therefor, suds suppression agents, soil suspending and anti-redeposition agents, enzymes, optical brighteners colouring agents and perfumes.

Nonionic and zwitterionic surfactants may be incorporated in amounts of up to 50% by weight of the total surfactant but normally are present in amounts of less than 30%. By 'total surfactant' is meant the sum of the anionic surfactant (a) cationic component (c) and any added nonionic and/or zwitterionic surfactant. The incorporation of 15–25% nonionic surfactant based on the total surfactant weight (corresponding to 1–2% on a total composition basis) has been found to provide advantages in the removal of oily soils. Suitable nonionics are water soluble ethoxylated materials of HLB 11.5–17.0 and include (but are not limited to) $C_{10}$–$C_{20}$ primary and secondary alcohol ethoxylates and $C_6$–$C_{10}$ alkylphenol ethoxylates. $C_{14}$–$C_{18}$ linear primary alcohols condensed with from seven to thirty moles of ethylene oxide per mole of alcohol are preferred, examples being $C_{14}$–$C_{15}$ $(EO)_7$, $C_{16}$–$C_{18}$ $(EO)_{25}$ and especially $C_{16}$–$C_{18}$ $(EO)_{11}$.

Suitable zwitterionic surfactants include the $C_{12}$–$C_{16}$ alkyl betaines and sultaines. These and other zwitterionic and nonionic surfactants are disclosed in Laughlin & Heuring U.S. Pat. No. 3,929,678, by reference.

However a particularly preferred optional ingredient is a smectite-type clay serving as an auxiliary textile softening agent.

The smectite clays particularly useful in the practice of the preferred embodiment of the present invention are sodium and calcium montmorillonites, sodium saponites, and sodium hectorites. The clays used herein are impalpable ie. they have a particle size which cannot be perceived tactilely, (in practice, less than about 50 microns) and normally have a particle size range of from about 5 microns to about 50 microns.

The clay minerals can be described as expandable, three-layer clays, i.e., aluminosilicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

These are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{4-y}(Al_{4-x}Mg_x)O_{20}$, nontronite $(OH)_4\ Si_{8-y}Al_y(Al_{4-x}Fe_x)O_{20}$, and volchonskoite $(OH)_4Si_{8-y}Al_y\ (Al_{4-x}Cr_x)O_{20}$, where x has a value of from 0 to about 4.0 and y has a value of from 0 to about 2.0. Of these only montmorillonites having exchange capacities greater than 50 meq/100 g provide appreciable fabric softening benefits and are useful for this purpose in compositions of the present invention.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4Si_{8-y}Al_y(Zn_{6-x}Al_x)O_{20}$, vermiculite $(OH)_4\ Si_{8-y}Al_y\ (Mg_{6-x}Fe_x)O_{20}$, wherein y has a value of 0 to about 6.0. Hectorite and saponite are the only minerals in this class that have appreciable fabric softening capability as the fabric softening performance is related to the type of exchangeable cation as well as to the exchange capacity. It is to be recognized that the amount of water of hydration in the above formulas can vary with the processing to which the clay has been subjected. This is immaterial to the use of the smectite clays as fabric softening agents in that the expandable characteristics of the hydrated clays are dictated by the silicate lattice structure.

As noted hereinabove, the clays suitable for use with the compositions of the present invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation.

Smectite clay $(Na)^+ \rightleftarrows$ smectite clay $(NH_4)+NaOH$. Since in the foregoing equilibrium reaction one equivalent weight of ammonium ion replaces an equivalent weight of sodium, it is customary to measure cation exchange capacity (sometimes termed "base exchange capacity") in terms of milli-equivalent per 100 g. of clay (meq/100 g). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain smectite clays. Illite clays, although having a three layer structure, are of a non-expanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyls containing Al and Mg atoms.

It has been determined that illite, attapulgite, and kaolinite clays, with their relatively low ion exchange capacities, are not useful as fabric softening ingredients. However, the alkali metal montmorillonites, saponites, and hectorites, and certain alkaline earth metal varieties of these minerals such as calcium montmorillonites have been found to show useful fabric softening benefits when incorporated in compositions in accordance with the present invention.

Specific non-limiting examples of such fabric softening smectite clay minerals are:

| |
|---|
| Sodium Montmorillonite |
| Brock |
| Volclay BC |
| Gelwhite GP |
| Thixo-Jel |
| Ben-A-Gel |
| Sodium Hectorite |
| Veegum F |
| Laponite SP |
| Sodium Saponite |
| Barasym NAS 100 |
| Calcium Montmorillonite |
| Soft Clark |
| Gelwhite L |
| Imvite K |
| Lithium Hectorite |
| Barasym LIH 200 |

Accordingly, smectite clays useful herein can be characterised as montmorillonite, hectorite, and saponite clay minerals having an ion exchange capacity of at least about 50 meq/100 g. and preferably at least 60 meq/100 g. Most of the smectite clays useful in the compositions herein are commercially available under various trade names, for example, Thixogel No. 1 and Gelwhite GP from Georgia Kaolin Co., Elizabeth, N.J.; Imvite K from Industrial Mineral Ventures; Volclay BC and Volclay 325, from American Colloid Co., Skokie Ill.; and Veegum F from R. T. Vanderbilt. It is to be recognised that such smectite minerals obtained under the foregoing tradenames can comprise mixtures of the various discrete mineral entities. Such mixtures of the smectite minerals are suitable for use herein.

Within the classes of montmorillonite, hectorite and saponite clay minerals having a cation exchange capacity of at least about 50 meq/100 g., certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use as a fabric softening component of detergent compositions. Imvite K is also very satisfactory.

Appropriate clay minerals for use herein can be selected by virtue of the fact that smectites exhibit a true 14A x-ray diffraction pattern. This characteristic exchange pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e., they display swelling characteristics in aqueous media. Conversely they do no swell in nonaqueous or predominantly non aqueous systems. When used in compositions according to the invention, the smectite clay is present in an amount of from about 1.5% to about 35% by weight of the composition, preferably from about 4% to about 15%, especially from about 5% to about 12%.

Detergent builder salts are a preferred component (e) of the compositions of the invention and can be inorganic or organic in character. Non-limiting examples of suitable water-soluble, inorganic alkaline detergent builder salts include the alkali metal carbonates, borates, phosphates, polyphosphates, bicarbonates, and silicates. Specific examples of such salts include the sodium and potassium tetraborates, bicarbonates carbonates, tripolyphosphates, pyrophosphates, penta-polyphosphates and hexametaphosphates. Sulphates are usually also present.

Examples of suitable organic alkaline detergency builder salts are:

(1) water-soluble amino polyacetates, e.g., sodium and potassium ethylenediaminetetraacetates, nitrilotriacetates, N-(2-hydroxyethyl) nitrilodiacetates and diethylene triamine pentaacetates;

(2) water-soluble salts of phytic acid, e.g. sodium and potassium phytates;

(3) water-soluble polyphosphonates, including sodium, potassium and lithium salts of methylenediphosphonic acid and the like and aminopolymethylene phosphonates such as ethylenediaminetetramethylenephosphonate and diethylene triaminepentamethylene phosphonate, and polyphosphonates described in British Patent application 38724/77.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid 1,1,2,2-ethane tetracarboxylic acid, mellitic acid and pyromellitic acid.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate, incorporated by reference herein.

Another type of detergency builder material useful in the present compositions and processes comprises a water-soluble material capable of forming a water-soluble reaction product with water hardness cations preferably in combination with a crystallization seed which is capable of providing growth sites for said retention product. Such "seeded builder" compositions are fully disclosed in British Pat. No. 1,424,406, incorporated by reference herein.

Preferred water soluble builders are sodium tripolyphosphate and sodium silicate, and usually both are present. In particular, it is preferred that a substantial proportion, for instance from about 3 to about 15% by weight of the composition of sodium silicate (solids) of ratio (weight ratio $SiO_2$:$Na_2O$) from about 1:1 to about 3.5:1 by employed.

A further class of detergency builder materials useful in the present invention are insoluble sodium aluminosilicates, particularly those described in Belgian Pat. No. 814,874, issued Nov. 12, 1974, herein incorporated by reference. This patent discloses and claims detergent compositions containing sodium aluminosilicate of the formula:

$$Na_z(AlO_2)_z(SiO_2)_y xH_2O$$

wherein z and y are integers equal to at least 6, the molar ratio of z to y is in the range of from 1.0:1 to about 0.5:1 and x is an integer from about 15 to about 264. A preferred material is $Na_{12}(SiO_2AlO_2)_{12}27H_2O$. About 5% to about 25% by weight of aluminosilicate may be used as a partial replacement for water-soluble builder salts, provided that sufficient water-soluble alkaline salts remain to provide the specified pH of the composition in aqueous solution.

The detergent builder salts are normally included in amounts of from about 10% to about 80% by weight of the composition preferably from about 20% to about 70% and most usually from about 30% to about 60% by weight.

Bleaching agents useful in the compositions of the invention include sodium perborate, sodium percarbonate and other perhydrates at levels of from about 5% to about 35% by weight of the composition. Organic peroxy bleach precursors such as tetra acetyl ethylene diamine and tetra acetyl glycouril can also be included and these and other precursors are disclosed in Belgian Pat. No. 859461 published Apr. 6, 1978, incorporated by reference.

In compositions incorporating oxygen bleaches, bleach stabilisers are also preferred components usually at levels of from about 0.2% to about 2% by weight of the composition. The stabilisers may be organic in nature such as the previously mentioned amino polyacetates and amino polyphosphonates or may be inorganic such as magnesium silicate. In the latter case the material may be added to the formulation or formed in situ by the addition of a water-soluble magnesium salt to a slurried detergent mix containing an alkali metal silicate.

Suds controlling agents are often present. These include suds boosting or suds stabilising agents such as mono- or di-ethanolamides of fatty acids. More often in modern detergent compositions, suds suppressing agents are required. Soaps especially those having >18 carbon atoms, or the corresponding fatty acids, can act as effective suds suppressors if included in the anionic surfactant component of the present compositions. Usually about 1% to about 4% of such soap is effective as a suds suppressor. Very suitable soaps, when suds suppression is a primary reason for their use, are those derived from Hyfac (Trade Name for hardened marine oil fatty acids predominantly $C_{11}$ to $C_{22}$ acids available from the Humko Corporation).

However, non-soap suds suppressors are preferred in synthetic detergent based compositions of the invention since soap or fatty acid tends to give rise to a characteristic odour in these compositions.

Preferred uds suppressors comprise silicones. In particular there may be employed a particulate suds suppressor comprising silicone and silanated silica releasably enclosed in water soluble or dispersible substantially non-surface active detergent impermeable carrier. Suds suppressing agents of this sort are disclosed in British Pat. No. 1,407,997, herein incorporated by reference. A very suitable granular (prilled) suds suppressing product comprises 7% silica/silicone (15% by weight silanated silica, 85% silicone, obtained from Messrs. Dow Corning), 65% sodium tripolyphosphate, 25% Tallow alcohol condensed with 25 molar proportions of ethylene oxide, and 3% moisture. The amount of silica/silicone suds suppressor employed depends upon the degree of suds suppression desired but it is often in the range from about 0.01% to about 0.5% by weight of the detergent composition. Other suds suppressors which may be used are water insoluble, preferably microcrystalline, waxes having melting point in the range from about 35° C. to about 235° C. and saponification value less than 100, as described in British Pat. No. 1,492,938, incorporated by reference.

Yet other suitable suds suppressing systems are mixtures of hydrocarbon oil, a hydrocarbon wax and hydrophobic silica as described in European Patent application No. 782000035 and, especially, particulate suds suppressing compositions comprising such mixtures, combined with an ethoxylated nonionic surfactant having an HLB in the range from 14 to 19 and a compatibilising agent capable of forming inclusion compounds, such as urea. These particulate suds suppressing compositions are described in European Patent Application No. 0008830, incorporated by reference.

Soil suspending agents are usually present at about 0.1 to about 10%, such as water soluble salts of carboxymethyl cellulose, carboxyhydroxymethyl cellulose, polyethylene glycols of molecular weight of from about 400 to 10000 and copolymers of methylvinylether and maleic anhydride or acid, available under the Trade Name Gantrez.

Proteolytic, amylolytic or lipolytic enzymes, especially proteolytic, and optical brighteners, of anionic, cationic or nonionic types, especially the derivatives of sulphonated triazinyl diamino stilbene may be present.

Photoactivated bleaches such as the tri and tetra sulphonated derivatives of zinc phthalocyanine are also useful components of the present composition.

Colours, non-substantive, and perfumes, as required to improve the aesthetic acceptability of the product, are usually incorporated.

Throughout the description herein where sodium salts have been referred to potassium, lithium or ammonium etc., are justified for special reasons.

Preparation of the Compositions

The detergent compositions may be prepared in any way appropriate to their physical form, such as by dry mixing the components, co-agglomerating them or dispersing them in a liquid carrier. However a preferred physical form is a granule incorporating a detergent builder salt and this is most conveniently manufactured by spray drying at least part of the composition. For the purposes of the following discussion, components of the composition that are normally added to a detergent crutcher mix and spray dried are identified as (a), components which are applied in the liquid form by spray-on to other solid components are identified as (b) and components which are added as solids other than in the spray dried portion are identified as (c).

Conventionally, the compositions are prepared by making up an aqueous slurry of the non-heat-sensitive components (a), comprising the anionic and cationic surfactants, builder and filler salts together with any clay, soil suspending agents and optical brighteners, and spray drying this slurry. The moisture content of the slurry is normally in the range 28% to 36% and its temperature is conveniently in the range 70°–95° C. The spray drying tower inlet temperatures are normally in the range 300°–360° C. and the resultant spray dried granules have a moisture content of 8–12% by weight. An optional, but preferred, additional processing step is to cool the dried granules rapidly by means of cool air from a temperature of 90° C. to a temperature in the range 25°–35° C. in order to facilitate the further processing of the product. Solid heat sensitive components (b), such as persalts and enzymes, are mixed with the spray-dried granules. Although the water-insoluble amine component may be included in the slurry for spray drying it may degrade under certain processing conditions and adversely affect product quality. It is therefore preferred that the water-insoluble tertiary amine be liquified by melting or solvent dissolution and that this liquid (b) be sprayed onto the spray dried granules before or after other heat sensitive solids have been dry mixed with them. If the amine is applied as a melt, a liquid temperature 10°–30° C. in excess of the melting point can conveniently be used for the spray-on. Although the amine is generally a waxy solid of rather low melting point, the granules so made are surprisingly crisp and free-flowing. As noted above, the usual mode of incorporation of the water soluble cationic component is by addition to the slurried ingredients (a), as a convenient form of supply of the cationic component is as an aqueous solution. However, if the cationic component is supplied as a solid, it can be added with the heat sensitive solids (c), or dispersed in the liquified tertiary amine(b). The latter can be sprayed on to any particulate component or components of the composition which are able to act as carrier granules. Similarly the optional clay component can be dry mixed if so desired.

The invention is illustrated by the following non-limiting examples.

EXAMPLE 1

The following compositions were made up

| | A | B | C | D |
|---|---|---|---|---|
| (a) Sodium linear $C_{12}$ alkyl benzene sulphonate | 7.5 | 7.5 | 7.5 | 7.5 |
| (a) Sodium tripolyphosphate | 30.0 | 30.0 | 30.0 | 30.0 |
| (a) Sodium Silicate ($SiO_2Na_2O$ ratio 1.6:1) | 5.0 | 5.5 | 5.5 | 5.5 |
| (c) Sodium Perborate tetrahydrate | 24.0 | 24.0 | 24.0 | 24.0 |
| (c) Silica-Silicone suds suppressor | — | — | 0.2 | 0.2 |
| (c) Mineral oil-hydrophobic silica-wax suds suppressor | 0.2 | 0.2 | — | — |
| (a) Sodium sulphate | 18.0 | 8.0 | 16.0 | 6.0 |
| (b) Ditallow methyl amine | 6.0 | 6.0 | 6.0 | 6.0 |
| (b) $C_{12}$—$C_{14}$ alkyl trimethyl ammonium bromide | — | — | 2.0 | 2.0 |
| (a) Sodium Montmorillonite clay | — | 10.0 | — | 10.0 |
| (a) Optical brightener | 0.2 | 0.2 | 0.2 | 0.2 |
| (c) Proteolytic Enzyme | 0.3 | 0.3 | 0.3 | 0.3 |
| (a) Moisture and miscellaneous | 8.3 | 8.3 | 8.3 | 8.3 |

The compositions were made by first forming designated ingredients (a) into spray dried base granules. A molten slurry of the designated ingredients (b) was then made up by melting the di-tallow methyl amine, and, in the case of compositions C+D, by dispersing the cationic material therein. This molten mixture was then sprayed onto the base powder and allowed to solidify to give crisp free flowing granules into which were dry mixed the remaining ingredients (c).

The compositions were then used to wash 8lb soiled fabric loads in a Miele Model 422 Drum Automatic machine set to a prewash-mainwash cycle in which the mainwash was a boil wash. The water hardness was 14° Clark (Ca:Mg molar ratio 2:1) and the product usage was 70 g in the prewash and 140 g in the mainwash. Artifically soiled cotton tracers and clean terry towelling tracers were added to each wash to permit evaluation of respectively, the cleaning and softening performance of the compositions. Following the wash each load was air dried at ambient temperatures before being assessed by an expert panel.

In a paired comparison between tracers washed in compositions A and C using a Scheffe scale of assessment, composition C was rated better for softness than A by 1.5 panel score units with a least significant difference (LSD) of 1.12 psu at the 95% confidence level and also provided improved greasy soil removal relative to Composition A. In a similar comparison between tracers washed in compositions B and D, Composition D was rated better for softness by 2.0 panel score units than composition B with an $LSD_{95}$ of 0.64 and also showed improved greasy soil removal.

It can thus be seen that compositions C and D in accordance with the invention are superior in fabric softening performance to prior art softening compositions A and B whilst being equivalent to or slightly better than such compositions in cleaning performance.

In this example the ditallow methylamine component (b) in either of compositions C and D may be replaced by distearyl benzyl amine, dicetyl hydroxy ethylamine, ditallowyl allylamine or ditallowyl benzyl amine and corresponding results are obtained. The $C_{14}$ alkyl trimethyl quaternary component (c) may be replaced by lauryl methyl dihydroxyethyl ammonium bromide, lauryl primary amine, $C_{12}$–$C_{14}$ alkyl dimethyl amine, Coconut alkyl trimethyl ammonium bromide and N-tallowyl propylene diamine diacetate.

EXAMPLES 2 AND 3

The following compositions are in accordance with the invention

| | | | |
|---|---|---|---|
| Sodium $C_{12}$ alkyl benzene sulphonate | (a) | 6.5 | 5.70 |
| Tallow alcohol $(EO)_{11}$ | (a) | 2.0 | 1.75 |
| Sodium tripolyphosphate | (a) | 30.0 | 24.00 |
| Sodium Silicate ($SiO_2$:$Na_2O$ ratio 1.6:1) | (a) | 5.5 | 6.00 |
| Sodium Perborate tetrahydrate | (c) | 24.0 | 24.0 |
| Silica silicone suds suppressor (15:85) granules | (c) | 1.9 | 1.15 |
| Sodium ethylene diamine tetra acetate | (a) | 0.2 | 0.15 |
| Sodium sulphate | (a) | 11.0 | 15.0 |
| Sodium Carboxy methyl cellulose | (a) | 0.4 | 0.35 |
| Maleic anhydride methyl vinyl ether copolymer (MWt 250,000) | (a) | — | 0.85 |
| Ditallow methyl amine | (b) | 5.0 | 4.40 |
| $C_{12}$—$C_{14}$ alkyl trimethyl ammonium chloride | (a) | 1.8 | 1.60 |
| Sodium Montmorillonite clay | (a) | 5.0 | 4.40 |
| OpticaL brightener | (a) | 0.2 | 0.15 |
| Proteolytic enzyme | (c) | 0.3 | 0.50 |
| Perfume | (b) | 0.2 | 0.20 |
| Moisture & Miscellaneous | | 6.0 | 9.80 |

The compositions were made by forming 32–34 wt % aqueous slurry of components (a) at a temperature in the range 85°–90° C. and spray drying the slurry to give a granular base powder. The order of addition of ingredients was anionic surfactant, silicate, minor ingredients, sulphate, nonionic, clay, cationic and finally phosphate. The copolymer of Example 3 was added with the CMC. Inlet air temperatures in the range 320° C. to 340° C. were used and the spray dried granules were subsequently cooled to 25°–35° C. in an air lift using ambient air as the cooling medium. The heat sensitive solid ingredients (c) were then added to the base powder through feeding devices known to those skilled in the art and the granule mix was subjected to a spray-on of the tertiary amine component (b) into which perfume material has been blended.

EXAMPLES 4–11

Further compositions in accordance with the invention are given below:

| | 4 | 5 | 6 | 7 | 8 | 9 | 10 | 11 |
|---|---|---|---|---|---|---|---|---|
| Sodium $C_{12}$ linear alkyl benzene sulfonate | 8.0 | 6.0 | 2.0 | 4.0 | 8.0 | — | 12.0 | 5.7 |
| Sodium tallow alkyl sulphate | — | — | — | 4.0 | — | — | — | — |
| Sodium tallow alkyl $(EO)_3$ sulphate | — | — | — | 2.0 | — | 4.0 | — | — |
| Sodium $C_{16}$ paraffin sulphonate | — | — | 6.0 | — | — | 6.0 | — | — |
| $C_{14}$—$C_{15}$ linear primary alcohol $(EO)_7$ | — | — | — | — | 2.0 | — | — | — |
| $C_{16}$—$C_{18}$ linear primary alcohol $(EO)_{11}$ | — | — | 2.0 | — | — | 2.0 | — | 1.8 |
| $C_{11}$—$C_{15}$ linear secondary alcohol $(EO)_7$ | — | 2.0 | — | 2.0 | — | — | — | — |
| Coconut primary alcohol $(EO)_6$ | — | — | — | — | — | — | 2.0 | — |
| Ditallow allylamine | — | — | — | — | — | 6.0 | — | — |
| Ditallow benzylamine | — | — | — | 6.0 | — | — | 6.0 | — |
| Behenyl arachidyl methylamine | — | — | — | — | 4.0 | — | — | — |
| Dicetyl allylamine | — | 5.0 | — | — | — | — | — | — |
| Ditallow dimethylamine | 6.0 | — | 6.0 | — | — | — | — | 4.4 |
| $C_{12}$—$C_{14}$ trimethyl ammonium chloride | 3.0 | — | — | 2.5 | — | — | 2.0 | 1.6 |
| Coconut methylamine hydrochloride | — | 2.0 | — | — | — | — | — | — |
| $C_{14}$ alkyl methyl dihydroxy ethyl ammonium chloride | — | — | 2.5 | — | — | 2.0 | — | — |
| Coconut dimethylamine | — | — | — | — | 2.0 | — | — | — |
| Sodium montmorillonite clay | — | 10.0 | — | 8.0 | — | — | — | 4.4 |
| Calcium montmorillonite clay | — | — | 8.0 | — | — | 5.0 | — | — |
| Sodium hectorite clay | — | — | — | — | — | 10.0 | — | |
| Sodium sulphate | 16.0 | 6.0 | 1.5 | 10.0 | 12.8 | 2.0 | 10.0 | 20.0 |
| Sodium tripolyphosphate | 45.0 | 30.0 | 25.0 | 45.0 | — | 25.0 | 40.0 | 26.4 |
| Sodium carbonate | — | — | 5.0 | — | 10.0 | — | — | — |
| Sodium silicate ($SiO_2$:$Na_2O$ ratio = 1.6:1) | 10.0 | 6.0 | 10.0 | 6.0 | 6.0 | 6.0 | 7.5 | 4.9 |
| Sodium Zeolite A | — | 5.0 | — | — | 25.0 | 15.0 | — | — |
| Sodium perborate | — | 20.0 | 25.0 | — | 20.0 | 20.0 | — | 21.1 |
| Silica-Silicone suds suppressor | 0.2 | — | 0.2 | 0.2 | — | 0.2 | 0.2 | 1.2 |
| Hydrophobic silica-mineral oil-wax suds suppressor | — | 0.2 | — | — | 0.2 | — | — | — |
| Tetra sodium ethylene diamine tetra methylene phosphonate | — | 0.5 | 0.5 | — | 0.5 | 0.5 | — | — |
| Maleic anhydride-methyl vinyl ether copolymer | — | 0.5 | 1.0 | — | 0.5 | 0.5 | — | — |
| Stearic Acid | 0.2 | — | 0.2 | — | — | — | 0.3 | — |
| Tetrasulphonated zinc phthalocyanine | 0.2 | 0.2 | — | 0.2 | — | — | 0.2 | — |
| Optical Brightener | 0.1 | 0.1 | 0.1 | 0.1 | 0.1 | 0.1 | 0.1 | 0.15 |
| Proteolytic Enzyme | 0.3 | — | 0.3 | 0.3 | — | 0.3 | — | 0.25 |
| Perfume | 0.2 | 0.2 | 0.2 | 0.2 | 0.2 | 0.2 | 0.2 | 0.2 |
| Moisture and Miscellaneous | 10.6 | 7.3 | 6.5 | 9.5 | 8.5 | 7.2 | 9.5 | 7.9 |

We claim:

1. A textile softening and cleaning composition consisting essentially of (a) from about 3% to about 30% of an anionic surfactant (b) from about 1% to about 25% of a water-insoluble tertiary amine having the general formula

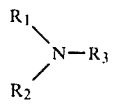

wherein $R_1$ is selected from $C_{10}$–$C_{26}$ alkyl and alkenyl groups, $R_2$ is selected from $C_{10}$–$C_{26}$ alkyl and alkenyl groups, or if $R_1$ is selected from $C_{20}$–$C_{26}$ alkyl and alkenyl groups, $R_2$ *is also selected from* $C_1$–$C_7$ alkyl groups, $R_3$ has the formula $—CH_2Y$ where Y is selected from hydrogen, $C_1$–$C_6$ alkyl

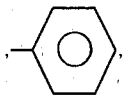

$—CH_2OH$, $—CH{=}CH_2$, $—CH_2CH_2OH$, $—CH_2CN$, $—CH_2CO(R_4)$, $—CH_2CO(N(R_5)_2)$ and $—CH_2CH_2N(R_6)_2$ wherein $R_4$ *is a* $C_1$–$C_4$alkyl group, each $R_5$ is independently selected from hydrogen and $C_1$–$C_4$ alkyl and each $R_6$ is independently selected from hydrogen and $C_1$–$C_{20}$ alkyl and (c) from about 0.5% to about 10% of a water soluble cationic compound selected from the group consisting of (i) quaternary ammonium compounds of formula $R_7R_8R_9R_{10}N^+X^-$ wherein $R_7$ is $C_8$–$C_{16}$ alkyl, and each of $R_8$, $R_9$ and $R_{10}$ is independently selected from $C_1$–$C_4$ alkyl, $C_1$–$C_4$ hydroxyalkyl, benzyl and $—(C_2H_4O)_xH$ where x has a value of from about 2 to about 5, not more than one of $R_8$, $R_9$ and $R_{10}$ being benzyl, and wherein X is an anion; and (ii) aliphatic amines of formula $R_{11}R_{12}R_{13}N$ wherein $R_{11}$ is $C_8$–$C_{18}$ alkyl, $R_{12}$ and $R_{13}$ are independently selected from hydrogen, $C_1$–$C_4$ alkyl, $C_1$–$C_4$ hydroxy alkyl, benzyl, $—(C_2H_4O)_xH$, where x has a value of from about 2 to about 5, and water soluble salts thereof, provided that the molar ratio of component (c) to component (a) does not exceed 1:1.

2. A textile softening and cleaning composition according to claim 1 wherein the molar ratio of (c) to (a) does not exceed 1:1.5.

3. A textile softening and cleaning composition according to claim 1 wherein the molar ratio of (c) to (a) does not exceed 1:2.

4. A textile softening and cleaning composition according to claim 1 wherein the water insoluble tertiary amine (b) is a compound in which $R_1$ and $R_2$ are each $C_{12}$–$C_{22}$ alkyl groups and $R_3$ is selected from methyl, benzyl, allyl, 2-hydroxyethyl and 2-cyanoethyl groups.

5. A textile softening and cleaning composition according to claim 1 wherein the water soluble cationic compound (c) is a quaternary ammonium salt in which $R_7$ is a $C_{12}$–$C_{14}$ alkyl group and $R_8$, $R_9$ and $R_{10}$ are selected from methyl and hydroxyethyl groups.

6. A textile softening and cleaning composition according to claim 1, further including a water soluble ethoxylated nonionic surfactant of HLB 11.5–7.0 in an amount of up to about 50% by weight of the total anionic, cationic and nonionic surfactant.

7. A textile softening and cleaning composition according to claim 6 wherein the nonionic surfactant is selected from $C_{10}$–$C_{20}$ primary and secondary alcohol ethoxylates and $C_6$–$C_{10}$ alkyl phenol ethoxylates and is present in an amount of less than about 30% by weight of the total surfactant.

8. A textile softening and cleaning composition according to claim 1 further including from about 1.5% to about 35% by weight of the composition of component (d) consisting essentially of an impalpable smectite-type clay having an ion-exchange capacity of at least about 50 meq per 100 g.

9. A textile softening and cleaning composition according to claim 8 wherein the smectite clay is selected from sodium and calcium montmorillonites.

10. A textile softening and cleaning composition according to claim 1 further including a component (e) consisting essentially of from about 10% to about 80% by weight of the composition of a detergent builder salt.

11. A textile softening and cleaning composition consisting essentially of (a) from about 4% to about 15% by weight of the composition of an anionic surfactant (b) from about 1% to about 15% by weight of the composition of a water-insoluble tertiary amine having the general formula

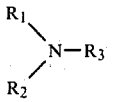

2 wherein $R_1$ is selected from $C_{10}$–$C_{26}$ alkyl and alkenyl groups, $R_2$ is selected from $C_{10}$–$C_{26}$ alkyl and alkenyl groups and, where $R_1$ is selected from $C_{20}$–$C_{26}$ alkyl and alkenyl groups, from $C_1$–$C_7$ alkyl groups, $R_3$ has the formula $—CH_2Y$ is selected from hydrogen, $C_1$–$C_6$ alkyl,

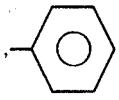

$—CH_2OH$, $—CH{=}CH_2$, $—CH_2CH_2OH$, $—CH_2CN$, $—CH_2CO(R_4)$, $—CH_2CO(N(R_5)_2)$ and $—CH_2CH_2N(R_6)_2$ wherein $R_4$ is a $C_1$–$C_4$ alkyl group, each $R_5$ is independently selected from hydrogen and $C_1$–$C_4$ alkyl and each $R_6$ is independently selected from hydrogen and $C_1$–$C_{20}$ alkyl;

(c) from about 1% to about 4% by weight of the composition of a water soluble cationic compound selected from the group consisting of (i) qauternary ammonium compounds of formula $R_7R_8R_9R_{10}N^+X^-$ wherein $R_7$ is $C_8$–$C_{16}$ alkyl, and each of $R_8$, $R_9$ and $R_{10}$ is independently selected from $C_1$–$C_4$ alkyl, $C_1$–$C_4$ hydroxyalkyl, benzyl and $—(C_2H_4O)_xH$ where x has a value of from about 2 to about 5, not more than one of $R_8$, $R_9$ and $R_{10}$ being benzyl, and wherein X is an anion; and (ii) aliphatic amines of formula $R_{11}R_{12}R_{13}N$ wherein $R_{11}$ is $C_8$–$C_{18}$ alkyl, $R_{12}$ and $R_{13}$ are independently selected from hydrogen, $C_1$–$C_4$ alkyl, $C_1$–$C_4$ hydroxy alkyl, benzyl $—(C_2H_4O)_xH$, where x has a value of from about 2 to about 5 and water soluble salts thereof, (d) from about 4% to about 15% by weight of the composition of an impalpable smectite-type clay having an ion exchange capacity of at least about 50 meq per 100 g; and (e) from about 20% to about 70% by weight of the composition of a detergent builder salt provided that the molar ratio of component (c) to component (a) does not exceed 1:1.5.

12. A textile softening and cleaning composition according to claim 11 further including an ethoxylated nonionic surfactant of HLB 11.5–17.0 in an amount less than about 30% by weight of the total anionic, cationic and nonionic surfactants.

13. A textile softening and cleaning composition according to claim 11 wherein the molar ratio of (c) to (a) does not exceed 1:2.

14. A textile softening and cleaning composition according to claim 11 wherein the water insoluble tertiary amine (b) is a compound in which $R_1$ and $R_2$ are each $C_{12}$–$C_{22}$ alkyl groups and $R_3$ is selected from methyl, benzyl, allyl, 2-hydroxyethyl and 2-cyanoethyl groups.

15. A textile softening and cleaning composition according to claim 11 wherein the water soluble cationic compound (c) is a quaternary ammonium salt in which $R_7$ is a $C_{12}$–$C_{14}$ alkyl group and $R_8$, $R_9$ and $R_{10}$ are selected from methyl and hydroxyethyl groups.

16. A textile softening and cleaning composition according to claim 12 wherein the nonionic surfactant is selected from $C_{10}$–$C_{20}$ primary and secondary alcohol ethoxylates and $C_6$14 $C_{10}$ alkyl phenol ethoxylates and is present in an amount of less than about 30% by weight of the toal surfactant.

17. A textile softening and cleaning composition according to claim 12 wherein component (a) is present at from about 5% to about 10% by weight (b) is present at from about 3% to about 6% by weight (c) is present at from about 1.5% to about 3% by weight (d) is present at from about 5% to about 12% by weight, the nonionic surfactant is selected from ethoxylated primary and secondary $C_{10}$–$C_{20}$ alcohols and is present in an amount of from about 15% to about 25% of the total surfactant, and the ratio of component (c) to component (a) is less than about 1:2.

18. A granular textile softening and cleaning composition according to claim 12 wherein component (b) is added to preformed granules comprising components (a), (c), (d), (e) and the ethoxylated nonionic surfactant.

19. A granular textile softening and cleaning composition according to claim 18 wherein the preformed granules are spray dried.

20. A granular textile softening and cleaning composition according to claim 18 wherein component (b) is added as a molten liquid spray.

21. A textile softening and cleaning composition as recited in claim 1, in which the water soluble cationic compound is aliphatic amine of the formula $$R_{11}R_{12}R_{13}N$$

wherein $R_{11}$ is $C_8$–$C_{18}$ alkyl, $R_{12}$ and $R_{13}$ are independently selected from hydrogen, $C_1$–$R_4$ alkyl, $C_1$–$C_4$ hydroxy alkyl, benzyl, $-(C_2H_4O)_xH$, where x has a value of from about 2 to about 5, or water soluble salt thereof.

22. A textile softening and cleaning composition as recited in claim 21 and consisting essentially of 6% sodium $C_{12}$ linear alkyl benzene sulfonate, 2% $C_{11}$–$C_{15}$ linear secondary alcohol $(EO)_7$, 5% dicetyl allylamine, 2% coconut methylamine hydrochloride, 10% sodium montmorillonite clay, 6% sodium sulfate, 30% sodium tripolyphosphate, 6% sodium silicate ($SiO_2$:$Na_2O$ ratio equal to 1.6:1), 5% sodium Zeolite A, 20% sodium perborate, 0.2% suds supressor, 0.5% tetra sodium ethylene diamine tetra methylene phosphonate, 0.5% maleic anhydride-methyl vinyl ether copolymer, 0.2% tetrasulfonated zinc phthalocyanine, 0.1% optical brightener, 0.2% perfume, the balance being moisture and miscellaneous.

23. A textile softening and cleaning composition as recited in claim 21 and consisting essentially of 8% sodium $C_{12}$ linear alkyl sulfonate, 2% $C_{14}$–$C_{15}$ linear primary alcohol $(EO)_7$, 4% behenyl arachidyl methylamine, 2% coconut dimethylamine, 12.8% sodium sulfate, 10% sodium carbonate, 6% sodium silicate ($SiO_2$:$Na_2O$ ratio equal to 1.6:1), 25% sodium Zeiolite A, 20% sodium perborate, 0.2% suds suppressor, 0.5% tetra sodium ethylene diamine tetra methylene phosphonate, 0.5% maleic anhydride-methyl vinyl ether copolymer, 0.1% optical brightener, 0.2% perfume, the balance being moisture and miscellaneous.

24. A textile softening and cleaning composition as recited in claim 5 in which the anionic surfactant is alkyl benzene sulfonate having from about 9 to about 15 carbon atoms in a linear or branched alkyl chain, and in which the water-insoluble tertiary amine is selected from the group consisting of ditallow methyl amine, distearyl benzyl amine, dicetyl hydroxyethyl amine, ditallowyl allylamine and ditallowyl benzyl amine.

25. A textile softening and cleaning composition as recited in claim 24, in which the water-insoluble tertiary amine comprises ditallow methyl amine.

* * * * *

UNITED STATES PATENT AND TRADEMARK OFFICE

CERTIFICATE OF CORRECTION

PATENT NO. : 4,338,204

DATED : July 6, 1982

INVENTOR(S) : Gianfranco L. Spadini et al.

It is certified that error appears in the above-identified patent and that said Letters Patent are hereby corrected as shown below:

Column 18, line 26, before "wherein", "2" should be deleted.

Column 19, line 32, "$C_6 14 C_{10}$" should be --$C_6$-$C_{10}$--.

Column 19, lines 44-45, after "weight" and before the comma, there should be inserted --(e) is present at from about 30% to about 60% by weight--.

Signed and Sealed this

Twenty-third Day of November 1982

[SEAL]

Attest:

GERALD J. MOSSINGHOFF

Attesting Officer

Commissioner of Patents and Trademarks